US005938429A

United States Patent [19]

Brenner

[11] Patent Number: 5,938,429

[45] Date of Patent: Aug. 17, 1999

[54] DEVICE FOR FEEDING AND IGNITING IN PARTICULAR GASOLINE AS FUEL FOR A VAPORIZING BURNER OF A HEATER

[75] Inventor: Dirk Brenner, Stuttgart, Germany

[73] Assignee: J. Eberspächer GmbH & Co., Esslingen, Germany

[21] Appl. No.: 08/952,292

[22] PCT Filed: Jun. 1, 1996

[86] PCT No.: PCT/DE96/00964

§ 371 Date: Nov. 5, 1997

§ 102(e) Date: Nov. 5, 1997

[87] PCT Pub. No.: WO97/01729

PCT Pub. Date: Jan. 16, 1997

[30] Foreign Application Priority Data

Jun. 28, 1995 [DE] Germany ..... 195 23 418

[51] Int. Cl.[6] ..... F23Q 7/08

[52] U.S. Cl. ..... 431/262; 431/263; 237/12.3 C

[58] Field of Search ..... 237/12.3 C; 431/260, 431/261, 262

[56] References Cited

U.S. PATENT DOCUMENTS 5,056,501 10/1991 Ida ..... 431/262

FOREIGN PATENT DOCUMENTS

| | | |
|---|---|---|
| 0 594 988 | 5/1994 | European Pat. Off. . |
| 37 08 745 C1 | 2/1988 | Germany . |
| 44 42 425 | 11/1995 | Germany . |
| 195 29 994 | 5/1996 | Germany . |
| 60-153477 | 8/1985 | Japan . |
| 61-134523 | 6/1986 | Japan . |

*Primary Examiner*—Carroll B. Dority
*Attorney, Agent, or Firm*—McGlew and Tuttle, P.C.

[57] ABSTRACT

A device for feeding and igniting in particular gasoline as fuel for the vaporizing burner of a heater, in particular a vehicle heater, is disclosed. The fuel evaporated from a porous body is mixed with combustion air and burned in a combustion chamber of the heater after being initially ignited by a glow plug. In order to simplify the design and improve the efficiency of the device, the glow plug is mounted in a pipe insulated from the outer wall of the combustion chamber and is radially surrounded by porous tubular body that projects beyond the free end of the glow plug into the combustion chamber. Combustion air is supplied in the radial direction to the porous body in the area of the free end of the glow plug and fuel is supplied in the radial direction to the opposite end of the porous body. The part of the porous body located outside the combustion chamber acts as a distributor and temporary reservoir when fuel is supplied.

10 Claims, 1 Drawing Sheet

DEVICE FOR FEEDING AND IGNITING IN PARTICULAR GASOLINE AS FUEL FOR A VAPORIZING BURNER OF A HEATER

FIELD OF THE INVENTION

The present invention pertains to a device for supplying and igniting especially gasoline as a fuel for a vaporizing burner of a heater, especially a vehicle heater, in which fuel evaporated from a porous body and mixed with combustion air is burned in a combustion chamber of the heater after an initial ignition by a pin-type glow plug.

BACKGROUND OF THE INVENTION

Such a device has been known from, e.g., DE 3708745 C1. The combustion air is fed in in a complicated manner in that prior-art device; it is fed to the porous body surrounding the glow electrode from the same end as is the fuel needed.

SUMMARY AND OBJECTS OF THE INVENTION

It is an object of the present invention to address the problem of bringing about an improvement and to generally provide a more reliably operating device of the type of a simple design as discussed above.

According to the invention, a device is provided for supplying and igniting especially gasoline as a fuel for a vaporizing burner of a heater, especially a vehicle heater. The fuel is evaporated from a porous body and mixed with combustion air and is burned in a combustion chamber of the heater after an initial ignition by a pin-type glow plug. The pin-type glow plug is mounted in a socket arranged insulated from the combustion chamber and is radially surrounded by a tubular porous body. The porous body extends into the combustion chamber beyond the free end of the pin-type glow plug. Combustion air is fed radially in the area of the free end of the pin-type glow plug. Fuel is fed at the opposite end, likewise radially.

The tubular porous body preferably contacts a porous combustion chamber lining which is present at least in the area in which the porous body opens into the combustion chamber wall. The combustion chamber may be designed tubularly with a lateral pocket shaped in it axially in parallel for accommodating the pin-type glow plug. The porous body preferably surrounds the pin-type glow plug and contacts the wall of the pocket in a heat-transferring manner. The combustion chamber lining may have a closed ring shape covering the pocket and may have an opening in the area of the free end of the porous body surrounding the pin-type glow plug.

The said socket can be plugged into a hole of a bottom part of the heater that can be attached by means of a flange and is secured axially via a said clamp. The clamp may be placed radially into a groove of the socket and may be screwed to the bottom part at an adjacent point. The socket may be secured against rotation by being in positive-locking contact with a projection of the bottom part. The socket may be formed of a material having poor thermal conductivity and/or is separated from the bottom part by an insulating material.

The present invention is based on the idea of mounting the porous body together with the pin-type glow plug surrounded by same in a common socket and of fixing this socket in an opening of a heater wall, which is insulated from the bottom of a tubular combustion chamber. In particular, no complicated feed means is needed to feed the combustion air to the porous body. This feed means is formed, instead, by a channel, which is shaped openly in an inner wall of the heater and opens into the opening for the part receiving the porous body. This channel is closed to form an air feed by a wall of the combustion chamber of the heater, which is laid on its open side. The fuel supply into the porous body takes place at a point located at a distance from the combustion chamber in order to prevent an excessively high temperature, which causes an immediate evaporation of the fuel fed in, from occurring at that point. Fuel storage and distribution undisturbed by the combustion air flowing in is achieved within the porous body due to the spatially separated supply of the fuel and of the combustion air at opposite ends of the tubular porous body. Such a uniform distribution or storage of fuel in a larger area of the tubular porous body compensates inequalities in fuel supply. These inequalities are especially the effects of a usually pulsating fuel supply, which has an adverse effect on the ignition and combustion of the fuel fed to the burner. The fuel for the device according to the present invention is preferably gasoline, which evaporates considerably more readily than diesel oil. Due to its easier evaporability, gasoline cannot, e.g., be fed directly to a porous fuel distribution body located in the combustion chamber, as it is usually done in the case of diesel oil, because the temperatures occurring within the combustion chamber during the operation of the burner are so high that a large-area distribution of the fuel fed in before the fuel evaporates completely, which is necessary for a favorable fuel distribution, is not possible.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

The bottom part 1 is flanged to a pot-shaped housing part, not shown, of the heater. The tubular combustion chamber 10 proper of the heater, which has a pot-shaped design and whose bottom is designed as a ring-shaped bottom with a central opening and lies at a flat wall 2 of the bottom part 1, is accommodated in the said pot-shaped housing part.

Figure 1:
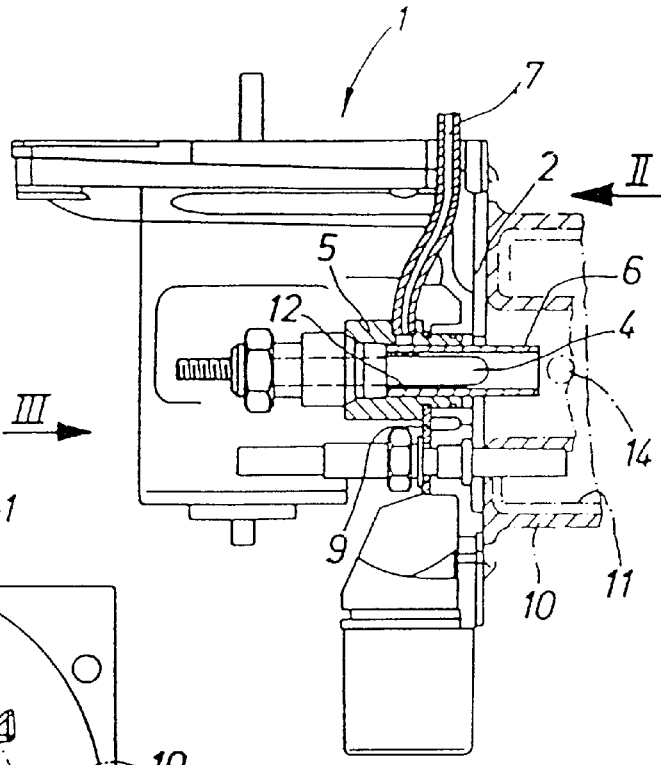
FIG. 1 is a sectional view through a bottom part of a heater, which can be attached by means of a flange, with a combustion chamber indicated in outlines.
Figure 2:
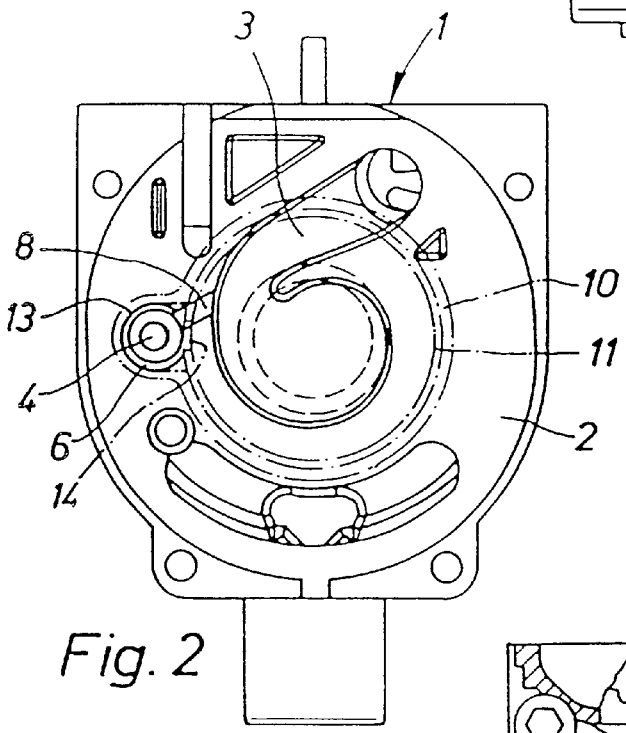
FIG. 2 is a view according to arrow II toward the bottom part that can be attached by means of a flange according to FIG. 1.
Figure 3:
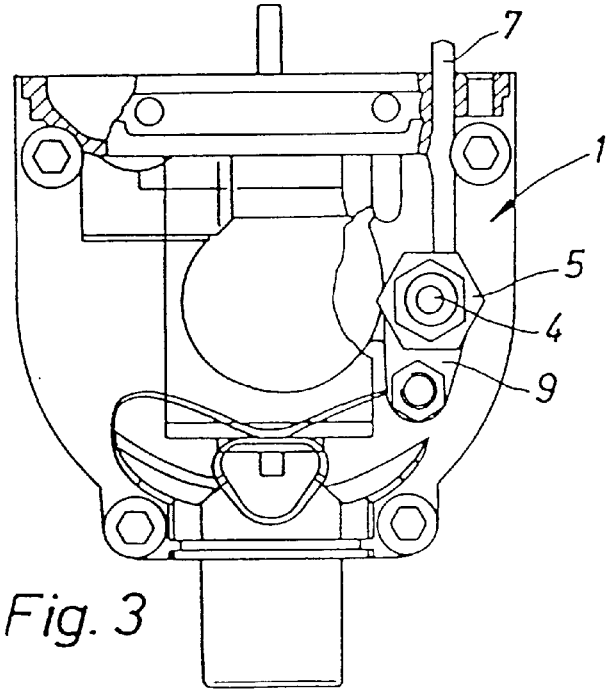
FIG. 3 is a view in the direction of arrow III toward the bottom part according to FIG. 1.

The combustion air needed for the operation of the burner enters the combustion chamber 10 through the channel 3 shown in FIG. 2, which is closed by the ring-shaped bottom of the combustion chamber 10 in the completely assembled heater.

The fuel introduced into the burner is ignited via a pin-type glow plug 4, which is accommodated in a socket 5 inserted into the bottom part 1.

A porous body 6, radially surrounding the pin-type glow plug 4, is mounted tensioned in the socket 5. This porous body 6 may consist of a nonwoven metal material. The end of the porous body 6 facing the free end of the pin-type glow plug 4 extends axially in parallel into a lateral pocket 13 of the combustion chamber 10.

With the heater assembled, a heat-insulating washer is located between the combustion chamber bottom and the bottom part 1. This heat-insulating washer prevents the direct flow of heat from the combustion chamber into the socket 5. As a result, the socket 5 is maintained at a temperature that is considerably lower than that of the walls of the combustion chamber. This is very important for the function of the igniting device according to the present invention in order to prevent, e.g., gasoline as a fuel fed in from igniting directly at its point of entry into the porous body 6. The fuel is fed in in the area of the foot of the pin-type glow plug 4 via a feed means 7 leading radially into the socket 5. Due to this location of the feed means 7, the fuel enters the porous body 6 at a point relatively remote from the point of entry of the porous body into the pocket 13 of the combustion chamber 10. Without being evaporated, the fuel fed in can be distributed in the area of admission circumferentially in an axially relatively large area of the porous body 6 due to the relatively low temperature occurring there. The point of introduction of the gasoline is maintained at a relatively low temperature due to the fact that the point of admission for the combustion air to be fed in is placed in the area of the other end of the porous body 6. A channel 8, which is closed by the annular bottom of the combustion chamber 10 lying on it, is provided in the bottom part 1 for feeding in the combustion air. This channel 8 is supplied with combustion air from the combustion air feed channel 3.

The fuel to be burned is ignited in the igniting device described above in the area of the tip of the pin-type glow plug 4, in which the fuel evaporates first because of the highest temperature occurring there. After the ignition of the fuel fed in has taken place, the pin-type glow plug 4 is put out of operation. The flame in the burner is then supplied with fuel via the porous body 6, which is kept heated by the burning fuel. A porous lining 11, which is in contact with the inner wall of the tube of the combustion chamber 10 in a ring-shaped pattern, covers the pocket 13, and is contacted by the porous body 6, is located inside the combustion chamber 10. An opening 14 connecting the pocket 13 and the inner space of the combustion chamber 10 is located in the area of the lining 11 covering the pocket 13. After the ignition has taken place, the fuel fed in also evaporates via the lining 11. With the pin-type glow plug 4 switched off during the operation of the burner, the fuel slowly flows along the porous body 6, as a result of which it is heated and is continuously evaporated. The combustion takes place within the combustion chamber 10 due to the combustion air fed in. The porous body 6 surrounding the pin-type glow plug contacts the bottom of the pocket 13 in a heat-transferring manner in order to be sufficiently hot in its free front end area for the ignited burner operation. However, the temperature shall decrease toward the socket 5, which is ensured by the corresponding insulation of the socket.

The axial area of the tubular porous body 6 located in the foot area of the pin-type glow plug 4 is used as a distributing reservoir for the gasoline fed in. A certain storage function is necessary to possibly eliminate the adverse consequence of a pulsating fuel supply for a continuous combustion process.

The tubular porous body 6 is fixed within the socket 5 by an axial abutment formed by the combustion chamber 10.

The socket 5, which may be made of a material having poor thermal conductivity, is simply pushed into a hole of the bottom part 1 and is sealed in the plugged-in area via a radial seal. The socket 5 is secured against rotation by positive-locking contact within a projection of the bottom part 1. Thermal insulation of the socket 5 against the heat originating from the combustion chamber 10 may also be ensured by an insulation insert between the socket 5 and the bottom part 1.

A clamp 9, which axially fixes the socket 5, may be fastened at the bottom part 1 especially in cases in which a part, which is to be screwed on firmly, is located at the bottom part 1 next to the socket 5. The opening edge of the clamp 9 surrounding the socket 5 may engage for this purpose a radial groove of the socket 5.

The tubular porous body 6 may lie radially directly on the pin-type glow plug 4 or it may be located at a short distance therefrom. If a distance is present, a sleeve 12 filling the radial space may be provided in the foot area of the rod electrode 4. The distribution of the fuel within the porous body 6 can be improved as a result.

While a specific embodiment of the invention has been shown and described in detail to illustrate the application of the principles of the invention, it will be understood that the invention may be embodied otherwise without departing from such principles.

I claim:

1. A device for supplying and igniting fuel for a vaporizing burner of a heater, comprising:

a tubular porous body;

a combustion chamber of the heater;

a pin-type glow plug;

a socket disposed adjacent to said combustion chamber, said pin-type glow plug being mounted in said socket arranged insulated from said combustion chamber and being radially surrounded by said tubular porous body, said tubular porous body extending into said combustion chamber beyond a free end of said pin-type glow plug;

a radial combustion air feed, for feeding combustion air radially in an area of said free end of said pin-type glow plug; and a radial fuel feed, for feeding fuel radially to said porous body at an end of said pin-type glow plug opposite said free end.

2. The device in accordance with claim 1, further comprising: a porous combustion chamber lining present in said combustion chamber at least in an area in which said porous body opens into a combustion chamber wall said tubular porous body contacting said porous combustion chamber lining.

3. The device in accordance with claim 1, wherein said combustion chamber is designed tubularly with a lateral pocket shaped in it axially in parallel for accommodating said pin-type glow plug, in which said porous body surrounding said pin-type glow plug contacts a wall of the said pocket in a heat-transferring manner.

4. The device in accordance with claim 1, wherein said combustion chamber lining has a closed ring shape covering said pocket and has an opening in an area of said free end of said porous body surrounding said pin-type glow plug.

5. The device in accordance with claim 1, wherein said socket is plugged into a hole of said bottom part of said heater, said bottom part being attached by means of a flange and secured axially via a clamp, said clamp being placed radially into a groove of said socket and being screwed to said bottom part at an adjacent point.

6. The device in accordance with claim 1, wherein said socket is secured against rotation by being in positive-locking contact with a projection of said bottom part.

7. The device in accordance with claim 1, wherein said socket is formed of a material having poor thermal conductivity.

8. The device in accordance with claim 1, wherein said socket is formed of a material having poor thermal conductivity and is separated from said bottom part by an insulating material.

9. The device in accordance with claim 1, wherein said socket is separated from said bottom part by an insulating material.

10. A device for supplying and igniting gasoline as a fuel for a vaporizing burner of a heater, comprising:

a porous body for receiving gasoline;

a combustion chamber of the heater;

a pin-type glow plug;

a socket disposed adjacent to said combustion chamber, said pin-type glow plug being mounted in said socket arranged insulated from said combustion chamber and being radially surrounded by said tubular porous body, said tubular porous body extending into said combustion chamber beyond a free end of said pin-type glow plug;

a radial combustion air feed, for feeding combustion air radially in an area of said free end of said pin-type glow plug; and a radial gasoline feed, for feeding gasoline radially to said porous body at an end of said pin-type glow plug opposite said free end, whereby gasoline is evaporated from said porous body and mixed with combustion air and is burned in said combustion chamber of the heater after an initial ignition by said pin-type glow plug.

* * * * *